US006390791B1

(12) United States Patent
Maillefer et al.

(10) Patent No.: US 6,390,791 B1
(45) Date of Patent: May 21, 2002

(54) MICRO PUMP COMPRISING AN INLET CONTROL MEMBER FOR ITS SELF-PRIMING

(75) Inventors: Didier Maillefer, Belmont Sur Lausanne; Harald Van Lintel, Lausanne, both of (CH)

(73) Assignee: Westonbridge International Limited, Wellington Quay (IE)

( * ) Notice: Subject to any disclaimer, the term of this patent is extended or adjusted under 35 U.S.C. 154(b) by 0 days.

(21) Appl. No.: 09/486,111

(22) PCT Filed: Aug. 19, 1998

(86) PCT No.: PCT/EP98/05471

§ 371 Date: Feb. 18, 2000

§ 102(e) Date: Feb. 18, 2000

(87) PCT Pub. No.: WO99/09321

PCT Pub. Date: Feb. 25, 1999

(30) Foreign Application Priority Data

Aug. 20, 1997 (FR) ..... 97 10497

(51) Int. Cl.[7] ..... F04B 17/00

(52) U.S. Cl. ..... 417/413.3; 417/413.2; 251/129.01; 251/129.06

(58) Field of Search ..... 417/413.3, 413.2; 251/129.01, 129.06

(56) References Cited

U.S. PATENT DOCUMENTS 5,069,419 A * 12/1991 Jerman ..... 251/129.01 X
5,216,273 A * 6/1993 Doering et al. ..... 251/129.01 X
5,224,843 A * 7/1993 van Lintel ..... 417/413.2
5,271,724 A * 12/1993 van Lintel ..... 417/413.2
5,277,556 A * 1/1994 van Lintel ..... 417/413.2
5,529,279 A * 6/1996 Beatty et al. ..... 251/129.01 X
5,542,821 A * 8/1996 Dugan ..... 417/413.2
5,785,295 A * 7/1998 Tsai ..... 251/129.01 X
6,116,863 A * 9/2000 Ahn et al. ..... 417/413.3 X

* cited by examiner

*Primary Examiner*—Charles G. Freay
*Assistant Examiner*—Eric Hayes
(74) *Attorney, Agent, or Firm*—Wolf, Greenfield & Sacks, P.C.

(57) ABSTRACT

The invention relates to a micropump (10; 100) comprising at least a first plate (12), a second plate (20), an intermediate plate (18), a pump chamber (24), and inlet and outlet control members (28, 30). According to the invention, said inlet control member (28) is a non-return valve situated in the major portion of the thickness of said intermediate plate (18), being made of a moving member (40) and a membrane-forming portion (42) situated close to one of the plates (12, 20), connecting said moving member (40) to the remainder of said intermediate plate (18) and, by its resilience, enabling said valve (28) to move between a closed position and an open position, said moving member (40) having an orifice of limited volume passing therethrough.

18 Claims, 4 Drawing Sheets

FIG.3
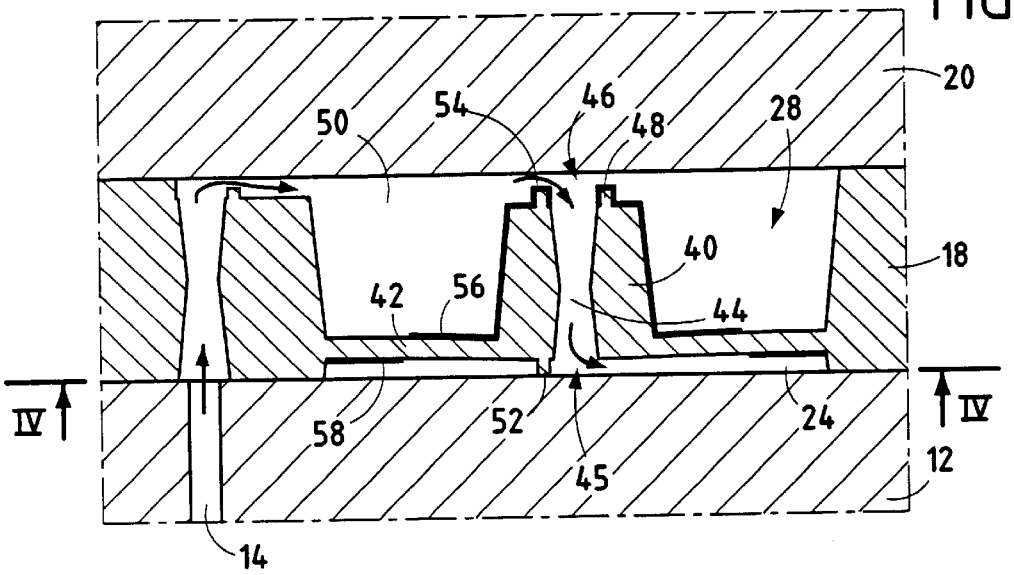
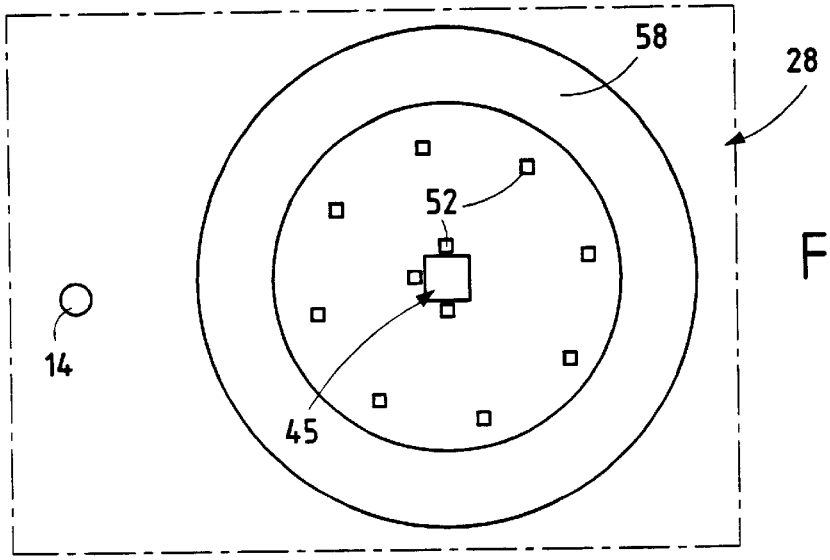
FIG.4
FIG.5
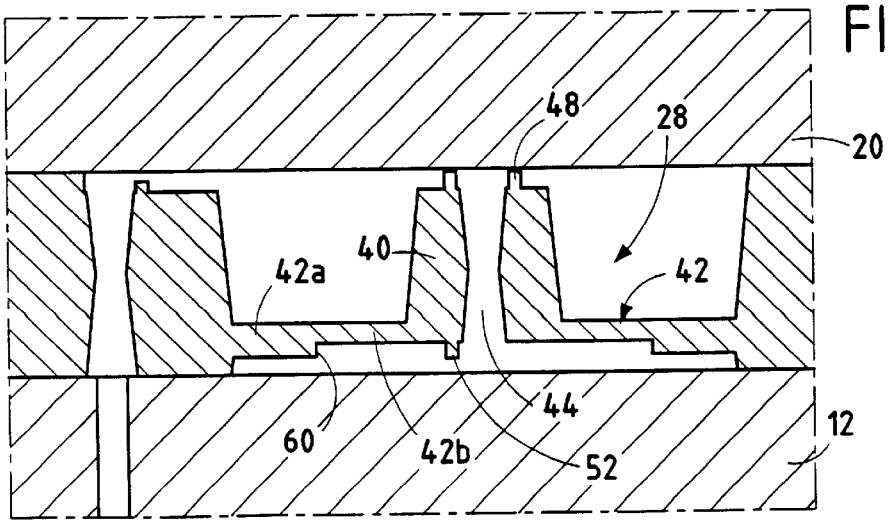

MICRO PUMP COMPRISING AN INLET CONTROL MEMBER FOR ITS SELF-PRIMING

The invention relates to a fluid flow device such as a micropump comprising at least a first plate, a second plate, an intermediate plate disposed between said first and second plates, a pump chamber defined by said first plate and said intermediate plate, and inlet and outlet control members communicating with said pump chamber, some inlet and outlet ducts passing through one of said first and second plates, said inlet control member being a non-return valve made up of a moving member and a membrane-forming portion connecting said moving member to the remainder of said intermediate plate, interposed between the inlet duct and the pump chamber, and, by virtue of its resilience, enabling said valve to move between a closed position and an open position, said moving member having an orifice passing therethrough between its first and second ends, said valve being shaped in such a manner that, in said open position, the moving member does not prevent liquid from flowing from said orifice towards said pump chamber, and the second end of the moving member being shaped in such a manner that, in said closed position, it provides sealed contact with that one of the plates that forms the seat of the valve.

For example, but in non-exclusive manner, such a device constitutes a micropump for medical use which regularly delivers a controlled quantity of medication. The manufacture of such micropumps is based on technologies for micro-machining silicon or any other material that can be machined by etching using photolitographic techniques. For the particular application mentioned above, and also in other cases, it is necessary to provide an inlet control member enabling the micropump to be self-priming. The micropump is controlled by varying the volume of its pump chamber (alternating decreases and increases of volume), e.g. by means of control using a piezoelectric actuator.

European patent application 95 905 674.9 describes such a self-priming micropump. However, the inlet valves described in that document are not easy to make.

European patent application 90 810 272.6 describes a micropump having an inlet member that forms a non-return valve, but that does not enable the pump to be self-priming.

The object of the present invention is to provide a fluid flow device such as a micropump having an inlet control member that enables said device to be self-priming in reliable manner, with the member being easy to manufacture.

According to the invention, this object is achieved by the facts that the moving member is situated in the major portion of the thickness of said intermediate plate, that the membrane-forming portion is situated close to the other one of the plates, and that said orifice presents a volume that is limited.

It will be understood that the liquid inlet control member included in the device of the present invention constitutes a non-return valve of the seated-valve type. The non-return valve has a membrane portion whose resilience makes it possible to open and close the valve, and a moving member that surrounds an orifice through which liquid can flow. At one of its ends, the moving member also has means for ensuring that said inlet valve is sealed in its closed position, i.e. that the moving member bears in sealed manner against one of the plates adjacent to the valve, this plate forming the seat of the valve.

According to an essential characteristic of the invention, in order to avoid the moving member obstructing the pump chamber, provision is preferably made for the first end of the moving member adjacent to said membrane-forming portion to be provided with at least one abutment element designed to limit the movement of said valve from the closed position towards the open position, the free end of said abutment element coming into contact with the plate situated close to the membrane-forming portion in said open position without said abutment element preventing liquid from flowing from said orifice towards said pump chamber.

The invention will be better understood and secondary characteristics and advantages thereof will appear on reading the following description of embodiments given below by way of example.

It should be understood that the following description and drawings are given purely by way of non- limiting indication. Reference is made to the accompanying drawings, in which:

FIG. 3 is a view on a larger scale showing a detail of FIGS. 1 and 2, said detail concerning the zone of the micropump that includes the liquid inlet control member or inlet valve;

FIG. 4 is a fragmentary and diagrammatic view from beneath as seen in direction IV—IV, showing the inlet valve of FIG. 3;

FIG. 5 is a view analogous to that of FIG. 3, showing a variant embodiment of the non-return valve when in its closed position, this valve constituting the inlet control member of the micropump of the present invention.

Figure 1:
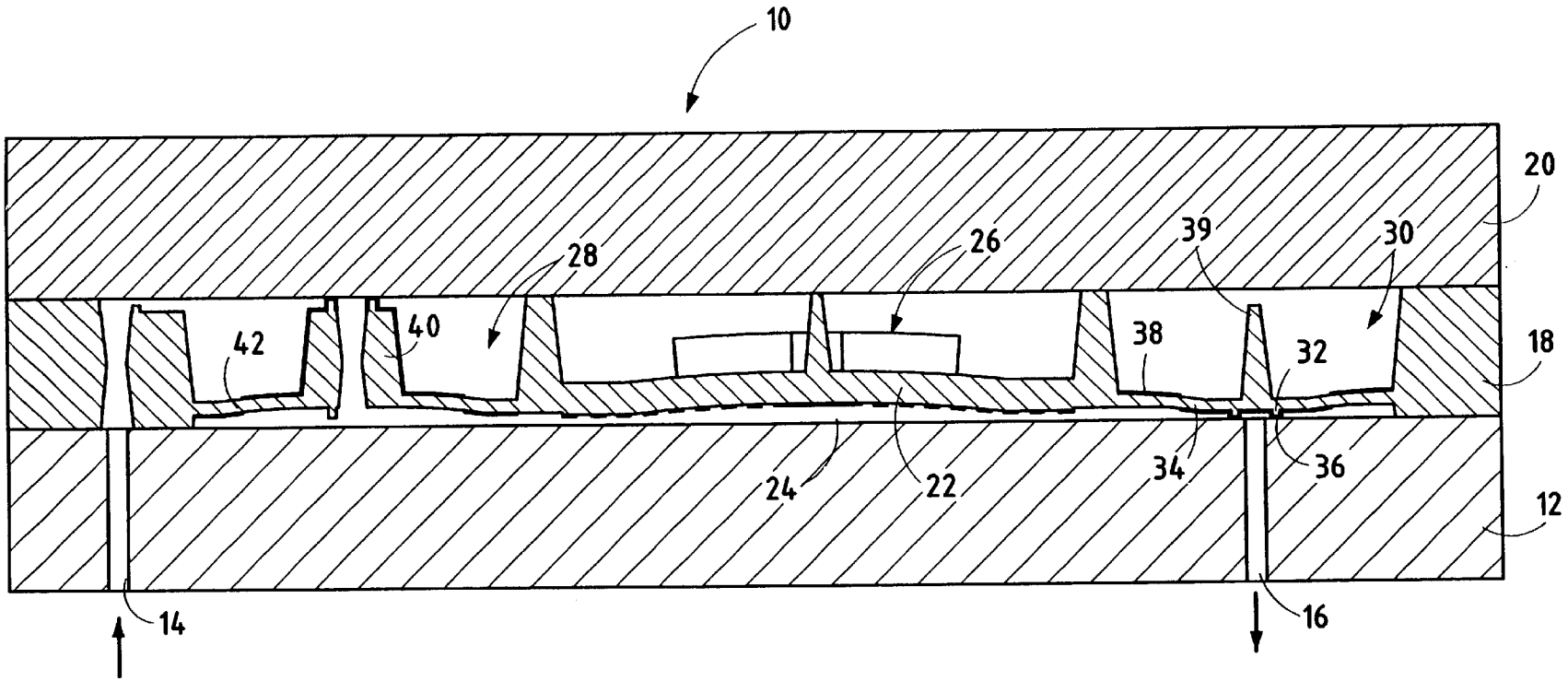
FIG. 1 is a longitudinal section through a first type of micropump of the invention.
Figure 2:
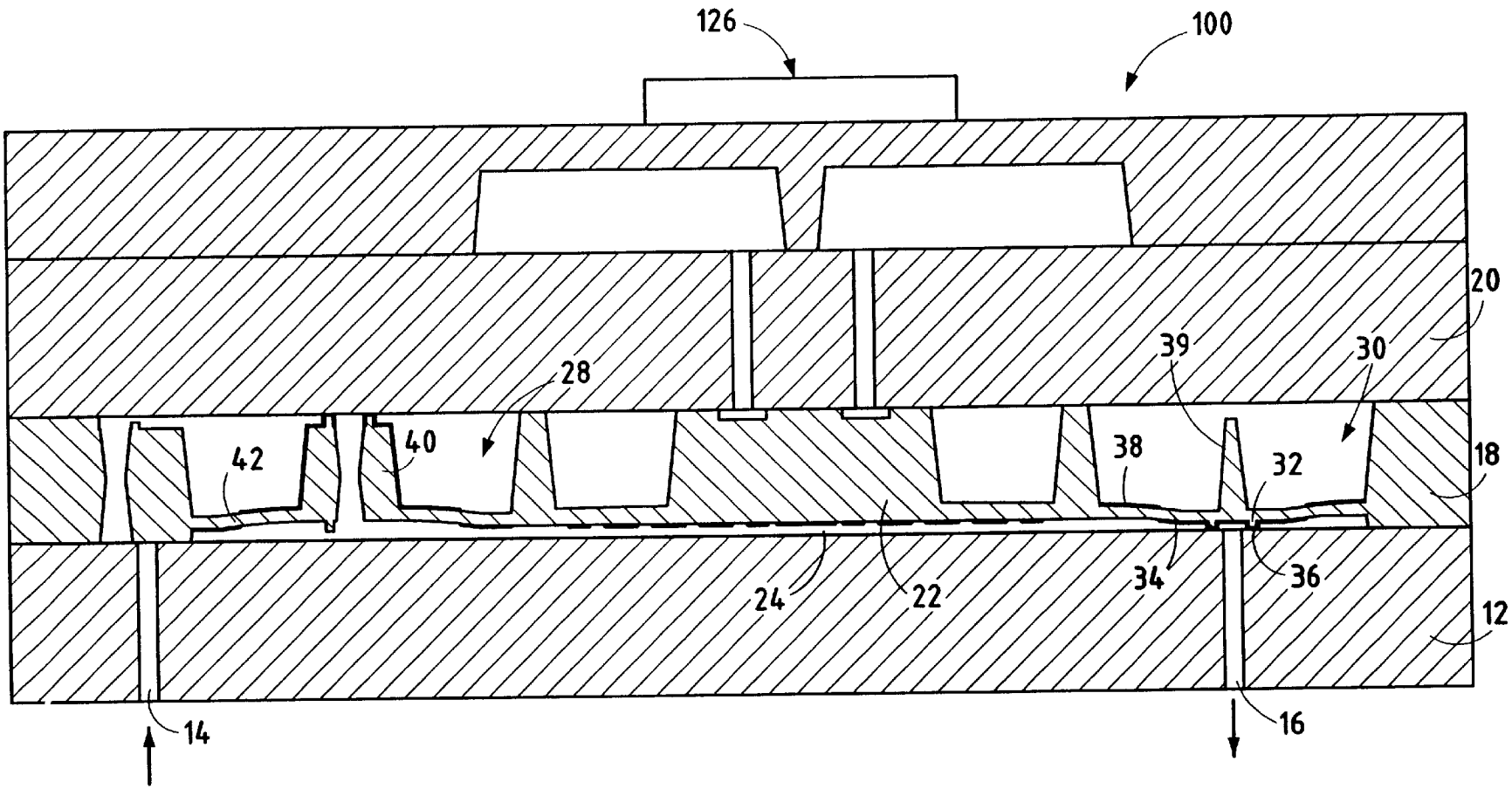
FIG. 2 is a view analogous to that of FIG. 1 relating to a second type of micropump, with FIGS. 1 and 2 showing the liquid inlet control member in its closed position.

In general, for a description of how the micropumps shown in FIGS. 1 and 2 operate, reference can be made to the above-mentioned European patent application 95 904 674.9 which also describes the method of making such micropumps. In order to visualize the various elements shown in FIGS. 1 and 2 more clearly, it should be observed that the thicknesses of the various plates making up the micropump are greatly exaggerated relative to the scale used in the longitudinal direction.

With reference to FIGS. 1 and 2, the micropumps 10 and 100 each comprise a base plate 12, preferably made of glass, having two through ducts 14 and 16 respectively forming an inlet duct and an outlet duct for the micropump.

An intermediate plate 18 is placed on the base plate 12, said intermediate plate preferably being made of silicon and being connected to the base plate 12 by the conventional technique of anodic bonding.

The intermediate plate 18 is surmounted by a top or "second" plate 20 which is preferably made of glass, with the intermediate plate and the second plate being connected together using the same technique as that used for connecting together the base plate 12 and the intermediate plate 18.

The first plate 12 and the second plate 20 are of a thickness that is substantially equal to about 1 mm, while the thickness of the intermediate plate is also substantially constant, but is smaller, in the range of 0.1 mm to 0.5 mm, preferably in the range 0.3 mm to 0.5 mm, and advantageously about 0.3 mm.

A portion of the intermediate plate 18 constitutes a pumping membrane 22 that is substantially circular in shape and that co-operates with the top face of the first plate 12 to define the pump chamber 24. The pumping membrane 22 constitutes a moving wall that is under the control of an actuator device 26, 126.

The inlet duct 14 is connected to the pump chamber 24 via one or more inlet control members 28 described in greater detail below. The pump chamber 24 is connected to a liquid outlet control member or outlet valve 30 of a structure that can be analogous to that described in above-mentioned European patent application 95 904 674.9.

In FIGS. 1 and 2, the outlet valve 30 shown has the elements described in the above-mentioned European patent application, i.e. an annular rib 32 placed facing the outlet duct 16 and in sealing contact with the top surface of the first plate 12 when the outlet valve 30 is in its closed position, a flexible membrane 34, and fine silicon oxide layers 36 and 38 serving respectively to prevent the annular rib 32 adhering to the first plate 12, and on the side of the membrane 34 facing away from the first plate 12, to create prestress that urges the edge of the rib 32 against the first plate 12.

The outlet valve 30 also has a stroke-limiter member 39 placed in register with the annular rib 32 on the face of the flexible membrane 34 that faces away from the first plate 12, the stroke-limiter member constituting an abutment element that bears against the second plate 20 when the outlet valve 30 is in its open position, thereby limiting the spacing between the annular rib 32 and the first plate 12.

The inlet control member or inlet valve 28 that can be seen in its closed position in FIGS. 1 and 2 is shown in greater detail in FIG. 3 where the inlet valve is shown in its open position.

As can be seen from the above-mentioned figures, the inlet valve 28 comprises a moving member 40 surrounded by a membrane-forming portion 42. The membrane 42 is substantially circular, having a diameter of about 3 mm, and its thickness, which is preferably substantially constant, is selected to lie in the range 10 $\mu$m to 50 $\mu$m, and is preferably about 25 $\mu$m.

Like the outlet valve 30, the or each inlet valve 28 constitutes a non-return valve in which a portion comes into abutment against one of the first and second plates when the valve is in its closed position.

The moving member 40 surrounds an orifice 44 passing through the moving member 40 from its first end 45 adjacent to the first plate 12 towards its second end 46 adjacent to the second plate 20.

The outside shape of the moving member 40 is preferably a body of revolution, for example its outside shape can be substantially in the form of a cylinder of circular section, or as shown in FIGS. 1 to 3, it can be in the form of a truncated cone with the larger portion thereof being directed towards the first plate 12.

It is necessary to minimize the volume of the orifice 44 constituting a connection space that is added to the volume of the pump chamber 24 so as to avoid constituting a volume that is too great relative to the volume of the pump chamber 24.

The orifice 44 can be of various shapes such as cylindrical, being of circular, square, or other section, a truncated cone, or in the form of a pyramid. If the technique used for etching the silicon plate constituting the intermediate plate 18 makes it possible to provide an orifice 44 of small diameter, then it is possible to make an orifice 44 that is of small section that is substantially uniform over the entire length of the orifice 44.

However, if the etching technique used for making the orifice 44 does not make it possible to provide an orifice whose section is relatively small and substantially constant along its entire length, then it is preferable to use the method of manufacture described below.

In a preferred embodiment of the invention, the orifice 44 is of a shape that comprises two square-based pyramids whose bases constitute the ends of said orifice, with the central zone of the orifice belonging to both pyramids. This shape made up of two oppositely-directed pyramids with their apexes coming into contact makes it possible to obtain an orifice 44 of a shape whose total volume is less than the volume of a single pyramid etched from either of the two ends of the moving member 40.

To make such an orifice 44 in the shape of two inverted pyramids, an advantageous solution consists in performing anisotropic etching from both ends 45 and 46 of the moving member 40. For this purpose, the orifice 44 is initially etched, e.g. from the first end 45 of the moving member 40, so as to form a square having a side of length that tapers with increasing depth of the orifice within the moving member 40. This provides the first or bottom portion of the orifice 44 with a section that tapers down to zero at the location corresponding to the apex of the pyramid constituted in this way.

To make a through orifice 44, the same type of etching as that described above is performed but starting this time from the second end 46 of the moving member 40, the orifice 44 then being fully implemented when, during the second etching stage, the above-mentioned first portion of the orifice 44 is reached, thus forming a through orifice 44.

It is thus possible to obtain two oppositely-directed pyramids having superposed apexes, or preferably two pyramids that have a volume portion in common, such that the narrowest section of the orifice 44 is large enough.

To clarify ideas, there follow various dimensions suitable for the orifice 44:

inlet or outlet section of the orifice 44: about 200 $\mu$m;
section in the center of the orifice 44: about 50 $\mu$m; and
length of the orifice 44: at least half the thickness of the intermediate plate 18.

When an orifice 44 is made whose section is substantially constant long its entire length, e.g. using a reactive ion micro-machining or etching method, an orifice 44 is obtained that is of small diameter, which diameter can be of the order of 10 $\mu$m to 100 $\mu$m.

In this manner, the volume of the pump chamber 24 is minimized because the membrane 42, whose surface faces the first plate, defines a portion of the pump chamber and is to be found very close to the first plate 12.

The volume of the orifice 44 is preferably not greater than one-fifth, and better not greater than one-tenth, of the unit pumping volume, i.e. the volume displaced on each opening-closing cycle of the pump, or the volume displaced by each up-down cycle of the pumping membrane 22.

To achieve this result, it is preferable for the ratio of the maximum distance between the closest portion of the membrane-forming plate over the thickness of the intermediate plate to be less than 1/20, and advantageously about 7 $\mu$m. In addition, and preferably, said membrane-forming portion, the first end of the moving member, and the outlet of the orifice are adjacent to the first plate, and the outlet of the orifice opens out directly into the pump chamber.

At the second end 46 of the moving member 40, there is an annular rib 48 surrounding the inlet of the orifice 44 and making it possible, when it is in contact against the bottom surface of the second plate 20, to provide sealing for the inlet valve 28. Naturally, it is better to have an annular rib 48 possessing a contact area that is as small as possible, firstly to ensure that the surface that needs to have a good surface state is of an area that is as small as possible, and secondly so as to provide an inlet valve 28 that can open for a relatively small pressure difference in the liquid between the inlet duct 14 and the pump chamber 24.

It will be understood that the pressure difference enabling the inlet valve 28 to be opened corresponds to the difference between the pressure of the liquid present in the connection space 50 placed upstream from the inlet valve 28 and the pressure of the liquid in the orifice 44, where said pressure is the same as the pressure in the pump chamber 24.

As can be seen in FIG. 3, when the liquid comes into the inlet duct 14, it passes into the connection space 50 and, once it has reached a certain pressure, it makes it possible to open the inlet valve 28, with the moving member 40 then moving down due to the resilience of the membrane 42. The liquid can then go from the connection space 50 into the orifice 44.

In accordance with a particularly advantageous characteristic of the present invention, in order to ensure that the liquid can pass from the orifice 44 to the pump chamber 24 when the inlet valve 28 is in the open position, a plurality of abutment elements 52 are provided on the surface of the first end 45 of the moving member 40 facing the first plate 12, which elements are in the form of small pillars each having one end secured to the first end of the moving member 40 and having its free, second end coming to bear against the top surface of the first plate 12. It will be understood that these abutment elements 52 constitute stroke limiters for the inlet valve 28 when it opens such that in its opening movement, when the moving member 40 comes close to the first plate 12, the situation does not arise in which the surface of the first end of the moving member 40 that surrounds the outlet of the orifice 44 comes to bear against the first plate 12, thereby closing the outlet from the orifice 44.

As can be seen more clearly in FIG. 4, the abutment elements 52 are provided in an arrangement such that they are distributed over the first end of the moving member 40. Thus, after entering into the orifice 44, the liquid can flow towards the pump chamber 24 by flowing round these abutment elements 52.

When the pressure of the liquid in the connection space 50 is equal to the pressure of the liquid in the pump chamber 24, the inlet valve 28 closes automatically by means of a return phenomenon whose origin is explained below. Thereafter, the actuator device 26, 126 causes the pump membrane 22 to move downwards so that the pressure of the liquid in the pump chamber is caused to be greater than the pressure of the liquid in the connection space situated downstream from the outlet valve 30. In this situation, the outlet valve opens as soon as the pressure difference is sufficient and the liquid then flows out from the pump chamber 24.

When the pressure of the liquid in the pump chamber 24 is equal to the pressure of the liquid in the connection space situated downstream from the outlet valve 30, the valve closes. Thereafter, the actuator device 26, 126 enables the pump membrane 22 to be released, which then rises and imparts maximum volume to the pump chamber. A new pump cycle identical to that described above can then begin.

Provision is made for the inlet valve 28 also to have a first silicon oxide layer 54 covering at least the surface of the second end 46 of the moving member 40 that can come into contact with the second plate 20 so as to ensure that the valve and the second plate do not become stuck together when the inlet valve 28 is in the closed position.

This first silicon oxide layer 54 covers at least the annular rib 48 in its zone that is to come into contact with the second plate 20, said fine layer of silicon oxide making it possible to prevent the moving member 40 sticking to the second plate 20. In order to ensure that the inlet valve 28 is closed when it is in its rest position, it is advantageous to provide silicon oxide layers 56 and 58 that are deposited on the membrane 42 so as to ensure that it is subjected to a certain amount of prestress acting upwards in the figures.

The oxide layer 56 is placed in the zone of the membrane-forming portion 42 which is adjacent to the moving member 40 and which faces towards the second plate 20, while the oxide layer 58 is disposed in a zone of the membrane 42 that is further away from the moving member 40 on its face facing the first plate 12.

As can be seen in the variant embodiment shown in FIG. 5, in order to reduce the volume of the pump chamber 24, it is possible to make a membrane 42 that is not of constant thickness.

Thus, as can be seen in FIG. 5, provision can be made for the surface of the membrane 42 that faces towards the first plate 12 to have a circular setback 60 centered around the orifice 44 so that a first portion 42*a* of the membrane 42 extending over an annular surface further away from the moving member 40 comes very close to the first plate 12, while a second portion 42*b* of the membrane 42 situated in a ring contiguous with the moving member 40 is at a greater distance from the first plate 12 than is the first portion 42*a* of the membrane.

Since the inlet valve 28 is preferably machined in the mass of the silicon intermediate plate 18 by using conventional photolithographic techniques, it is preferable to provide for the surface of the first portion 42*a* facing towards the first plate 12 to be parallel to the surface of the first plate 12 facing the inlet valve 28, and to be at the same level as the free ends of the abutment elements 52 since these two elements are machined simultaneously. Thus, these two elements are both placed at the same distance from said first plate 12 when the valve 28 is closed. Preferably, the free ends of the abutment elements 52 are planar and parallel to the surface of the first plate 12 adjacent to the pump chamber 24.

The inlet valve 28 of FIG. 5 does not have the oxide layers 54, 56, and 58 of FIG. 3 since it is shaped during manufacture so as to take up the closed position naturally, i.e. when it is in its rest position. In the absence of the layer 54, provision is made for at least the surface of the annular rib 48 facing the second plate 20 and/or for at least the surface of the second plate 20 facing the annular rib 48 to be treated, e.g. to be coated in an anti-adhesion layer, so as to prevent the valve 28 in the closed position adhering to the second plate 20.

Alternatively, an inlet valve 28 can be made with a staircase-forming membrane 42, as shown in FIG. 5, and including all or some of the silicon oxide layers 54, 56, and 58 as shown in FIG. 3. If a layer 58 is provided, then it is preferably restricted to the first portion 42*a* of the membrane 42.

Figure 6:
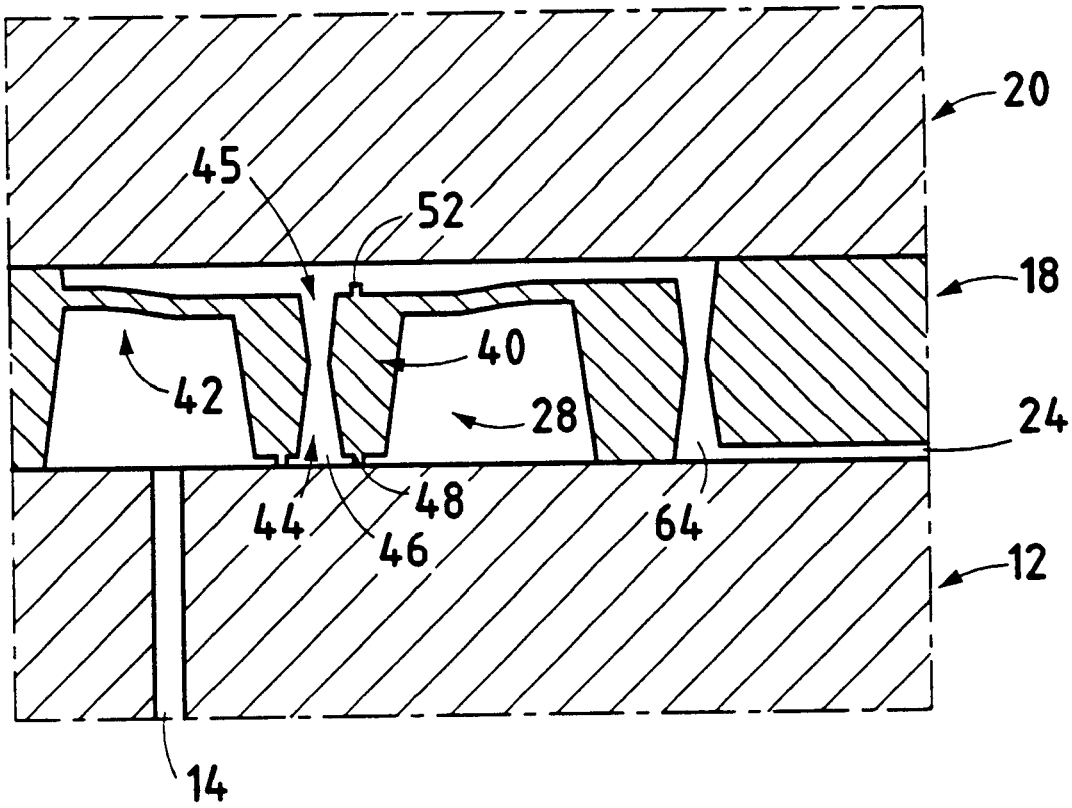
FIG. 6 shows the zone of the micropump as shown in FIG. 3, but provided with a variant embodiment of the non-return valve for liquid inlet.

The variant embodiment shown in FIG. 6 corresponds to a non-return inlet valve 28 in the closed position, whose position is reversed relative to that shown in FIG. 3. In this case, the membrane 42 is close to the second plate 20 and the seat of the valve 28 is formed by the annular zone of the top face of the first plate 12 facing the annular rib 48 directed downwards in FIG. 6 and placed on the second end 46 of the moving member 40. The abutment elements 52 are disposed at the first end 45 of the moving member 40, adjacent to the second plate 20 and extended by the membrane 42, and the moving member is extended radially by the membrane 42.

The orifice 44 has the same characteristics and can be made in the same manner as in the embodiments described above.

Because of the inverted organization of the inlet valve 28 in this variant embodiment, in order to ensure that the outlet from the orifice 44 (adjacent to the first end 45 of the moving member 40) is in fluid communication with the pump chamber 24 defined between the intermediate plate 18 and the first plate 12, an additional orifice 64, similar to the orifice 44, passes through the entire thickness of the intermediate plate 18 downstream from the inlet valve 28.

The operation of a micropump having an inlet valve 28 in accordance with any of the embodiments described above, remains identical to that of a micropump of any of the types described in the above-mentioned European applications.

In order to demonstrate the improved performance of the micropump of the invention compared with the performance of prior art micropumps, there follows a working example obtained using the embodiment of FIGS. 1 and 5 and an orifice 44 in the form of two inverted pyramids. The dead volume of the orifice 44 was $15\times10^{-9}$ liters (L), the dead volume defined beneath the valve 28, i.e. between the membrane 42 and the first plate 12, was $34\times10^{-9}$ L (by way of comparison the equivalent volume for the inlet valve in FIG. 7A of application EP 90 810 272.6 is greater than $500\times10^{-9}$ L), and the unit pumping volume was $150\times10^{-9}$ L. With such an inlet pump, the micropump had a compression ratio greater than 1, i.e. the ratio of unit pumping volume over the total dead volume.

This result is much better than that obtained with prior art micro-machined micropumps for liquid that are stated to be self-priming, which at best have a compression ratio of about 0.1.

What is claimed is:

1. A fluid flow device comprising a first plate, a second plate, an intermediate plate disposed between said first and second plates, a pump chamber defined by said first plate and said intermediate plate, an inlet control member and an outlet control member communicating with said pump chamber, said inlet control member being provided with an inlet duct passing through one of said first and second plates, said outlet control member being provided with an outlet duct passing through one of said first and second plates, said inlet control member being a non-return valve made up of a moving member formed in said intermediate plate and having a first end and a second end, said moving member comprising a membrane-forming portion interposed between the inlet duct and the pump chamber, said membrane-forming portion enabling, by virtue of its resilience, said non-return valve to move between a closed position and an open position, said moving member having an orifice passing therethrough between said first end and second end of said moving member, said non-return valve being shaped in such a manner that, in said open position, the moving member does not prevent liquid from flowing from said orifice towards said pump chamber, and said second end of said moving member being shaped in such a manner that, in said closed position, it provides sealed contact with that one of the first and second plates that forms the seat of the non-return valve, wherein said moving member is situated in the major portion of the thickness of the intermediate plate, wherein said membrane-forming portion is situated closer to the other one of the first and second plates that does not form the seat of the non-return valve than to the one of the first and second plates that forms the seat of the non-return valve, and in that said orifice presents a volume that is less than the volume of the pump chamber.

2. The device according to claim 1, wherein said first end of said moving member is adjacent to said membrane-forming portion and is provided with at least one abutment element having a free end and designed to limit movement of said valve from said closed position toward said open position said free end of said abutment element coming, in said open position, into contact with the other one of the first and second plates that does not form the seat of the non-return valve and which is situated close to said membrane-forming portion without said abutment element preventing liquid from flowing from said orifice towards said pump chamber.

3. The device according to claim 2, wherein said moving member has an outside shape that is substantially cylindrical and circular in section.

4. The device according to claim 1, wherein said orifice (44) is cylindrical in shape.

5. The device according to claim 1, wherein said orifice has a shape that is made up of two square-based pyramids whose bases constitute the ends of said orifice, with the central zone of said orifice belonging to both pyramids.

6. The device according to claim 1, wherein said orifice presents a volume that is no greater than one-fifth of the unit pumping volume.

7. The device according to claim 6, wherein said intermediate plate is made of silicon, and said non-return valve further comprises a first layer of silicon oxide covering at least the surface of said second end of the moving member that can come into contact with said one of the first and second plates forming the seat of the valve, thereby preventing said non-return valve and said plate from sticking together when the non-return valve is in the closed position.

8. The device according to claim 7, wherein said non-return valve further has a second layer of silicon oxide extending at least over the outside surface of the non-return valve in the zone of the membrane-forming portion which is adjacent to the moving member and which faces towards said one of the first and second plates forming the seat of non-return valve so as to generate pre-stress constraining the non-return valve to take up the closed position against said plate when the valve is in a rest position.

9. The device according to claim 1, wherein said intermediate plate is of substantially constant thickness lying in a range 0.3 mm to 0.5 mm.

10. The device according to claim 1, wherein said membrane-forming portion is of substantially constant thickness lying in a range 10 $\mu$m to 50 $\mu$m.

11. The device according to claim 1, wherein the surface of said membrane-forming portion has a setback facing towards said plate, that is situated close to the membrane-forming portion and that does not form the seat of the non-return valve and has a setback defining a first portion of said plate closer than a second portion contiguous with said moving member.

12. The device according to claim 11, wherein said setback is circular and is centered around said orifice, said first and second portions of said membrane-forming portion forming concentric rings.

13. The device according to claim 11 wherein the surface of said first portion that faces toward said plate, that is situated closer to the membrane-forming portion and that does not form the seat of the non-return valve and the free ends of said abutment forming elements are equidistant from said plate.

14. The device according to claim 1, wherein the maximum distance between the membrane-forming portion and the plate that is situated closer to the membrane forming portion and that does not form the seat of the non-return valve lies in the range of 3 $\mu$m to 20 $\mu$m.

15. The device according to claim 1, wherein a ratio of a maximum distance between the membrane-forming portion and the plate that is situated closer to the membrane-forming portion and that does not form the seat of the non-return valve over a thickness of said intermediate plate is less than 1/20.

16. The device according to claim 1, wherein said membrane-forming portion, said first end of said moving member and the outlet of said orifice are adjacent to said first plate, and the outlet of said orifice opens out directly into said pump chamber.

17. The device according to claim 1, wherein said membrane-forming portion, said first end of said moving member and the outlet of said orifice are adjacent to said second plate, and the outlet of said orifice communicates with said pump chamber by means of an additional orifice passing through an entire thickness of said intermediate plate.

18. The device according to claim 1, wherein said non-return valve includes a dead volume chamber situated upstream of said pump chamber and comprising said orifice, wherein said dead volume chamber presents a volume that is less than the volume of the pump chamber when said inlet control member is closed.

* * * * *